US009599341B2

(12) United States Patent
Hatta et al.

(10) Patent No.: US 9,599,341 B2
(45) Date of Patent: Mar. 21, 2017

(54) GLOW PLUG AND METHOD FOR MANUFACTURING SAME

(71) Applicant: NGK SPARK PLUG CO., LTD., Nagoya-shi, Aichi (JP)

(72) Inventors: Tomonari Hatta, Komaki (JP); Shuei Ishii, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 179 days.

(21) Appl. No.: 14/387,474

(22) PCT Filed: Mar. 6, 2013

(86) PCT No.: PCT/JP2013/001385

§ 371 (c)(1),
(2) Date: Sep. 23, 2014

(87) PCT Pub. No.: WO2013/145570

PCT Pub. Date: Oct. 3, 2013

(65) Prior Publication Data

US 2015/0076136 A1 Mar. 19, 2015

(30) Foreign Application Priority Data

Mar. 29, 2012 (JP) ..... 2012-075296

(51) Int. Cl.
*H05B 1/02* (2006.01)
*F23Q 7/00* (2006.01)

(52) U.S. Cl.
CPC ..... *F23Q 7/001* (2013.01); *F23Q 2007/004* (2013.01)

(58) Field of Classification Search
CPC . F23Q 7/001; F23Q 2007/004; H05B 3/0042; H05B 2003/027

(Continued)

(56) References Cited

U.S. PATENT DOCUMENTS 6,027,334 A 2/2000 Blaschke
7,624,620 B2 * 12/2009 Hirose ..... F23Q 7/001 73/35.12

(Continued)

FOREIGN PATENT DOCUMENTS

JP 64-031361 U 2/1989
JP 6-45144 Y2 11/1994

(Continued)

OTHER PUBLICATIONS

Search Report dated May 7, 2013, issued by the International Searching Authority in counterpart International Application No. PCT/JP2013/001385.

(Continued)

*Primary Examiner* — Mark Paschall
(74) *Attorney, Agent, or Firm* — Sughrue Mion, PLLC

(57) ABSTRACT

A glow plug includes a housing having an axial hold and provided with a screw portion, and a heater member inserted into the axial hole. The housing includes a front-end-side body portion extending to the front end side from a front end of the screw portion, and a gasket portion lying adjacent to a front end side of the front-end-side body portion and bent at a bent portion provided at a rear end thereof so that at least a rear end portion thereof extends in a direction intersecting a direction of an axis. The gasket portion includes a pressure contact portion in which a surface thereof located at an outer circumferential side is brought into pressure contact with a seat surface of an internal combustion engine when the screw portion is screwed into a mounting hole in the internal combustion engine.

5 Claims, 9 Drawing Sheets

(58) Field of Classification Search
USPC ..... 219/202, 205, 494, 523, 526, 538, 551
See application file for complete search history.

(56) References Cited

U.S. PATENT DOCUMENTS

| | | | | |
|---|---|---|---|---|
| 8,505,511 | B2 * | 8/2013 | Ramond | 123/179.21 |
| 9,222,424 | B2 * | 12/2015 | Takahashi | G01L 23/22 |
| 9,284,938 | B2 * | 3/2016 | Eguchi | F23Q 7/00 |
| 2001/0015402 | A1 * | 8/2001 | Murai | G01L 23/222 248/554 |
| 2010/0236512 | A1 | 9/2010 | Volland et al. | |

FOREIGN PATENT DOCUMENTS

| | | | |
|---|---|---|---|
| JP | 10-506982 | A | 7/1998 |
| JP | 2001-182937 | A | 7/2001 |
| JP | 2002-174423 | A | 6/2002 |
| JP | 2008-089233 | A | 4/2008 |
| JP | 2010-210102 | A | 9/2010 |
| JP | 2010-249354 | A | 11/2010 |

OTHER PUBLICATIONS

Office Action dated Jun. 11, 2015 issued by the Korean Intellectual Property Office in counterpart Korean Patent Application No. 10-2014-7027314.

* cited by examiner

GLOW PLUG AND METHOD FOR MANUFACTURING SAME

CROSS REFERENCE TO RELATED APPLICATIONS

This application is a National Stage of International Application No. PCT/JP2013/001385 filed Mar. 6, 2013, claiming priority from Japanese Patent Application No. 2012-075296, filed Mar. 29, 2012, the contents of all of which are incorporated herein by reference in their entirety.

TECHNICAL FIELD

The present invention relates to a glow plug used to preheat a diesel engine and the like, and a method for manufacturing the same.

BACKGROUND ART

Glow plugs, which are used in assisting a start of an internal combustion engine such as a diesel engine, include a tubular housing, a heater member which is energized to be heated, and the like. As the heater member, a ceramic heater having a heating element made of a conductive ceramic and a sheathed heater having a heating coil are adopted as from time to time.

In addition, the housing includes a screw portion for mounting to the internal combustion engine and a pressure contact portion which is brought into pressure contact with a seat surface provided to the internal combustion engine when the screw portion is screwed into a mounting hole in the internal combustion engine to ensure gastightness in a combustion chamber. In general, the pressure contact portion is configured by a front end surface of the housing which is formed so that an outer diameter thereof gradually reduces as it extends towards a front end in the direction of an axis thereof (for example, refer to Patent Literature 1 or the like). Additionally, when the glow plug mounted to the internal combustion engine, a compression force (an axial force) along the direction of the axis will be applied to a portion (a front-end-side body portion) of the housing which is located between the pressure contact portion and the screw portion. Then, the pressure contact portion is brought into pressure contact with the seat surface by a contact pressure which corresponds to the axial force.

PRIOR ART LITERATURE

Patent Literature

Patent Literature 1: JP-A-2008-89233

SUMMARY OF THE INVENTION

Problem that the Invention is to Solve

Incidentally, it is preferable that the thickness of the housing is reduced to realize a reduction in weight thereof from the viewpoint of improving the fuel economy of a vehicle and reducing the manufacturing costs. However, if the thickness of the housing is reduced, the contact area of the pressure contact portion with the seat surface will be reduced. Additionally, when considering the prevention of breakage of the housing, it is difficult to apply a large axial force to the housing (a front-end side body portion), and the contact pressure of the pressure contact portion against the seat surface may be reduced to a low level. As a result, a deterioration in gastightness in the combustion chamber may be caused or the glow plug may tend to easily loosen from the internal combustion engine due to vibration generated in association with the operation of the internal combustion engine.

To deal with the above problem, it is considered that the contact area of the pressure contact portion is ensured sufficiently by reducing an inclination angle (an acute angle of angles formed by an outline of the pressure contact portion and the axis in a section including the axis) of the pressure contact portion so as to improve the gastightness of the combustion chamber. In this case, however, the contact pressure of the pressure contact portion against the seat surface is reduced further, and the gastightness may not be ensured.

The invention has been made in view of these situations, and an object thereof is to provide a glow plug which can ensure good gastightness in a combustion chamber and also prevent the glow plug from being loosened from an internal combustion engine even when a housing thereof is thin, and a method for manufacturing the same.

Means for Solving the Problem

Hereinafter, configurations suitable for achieving the object will be described item by item. It is noted that specific working effects to the configurations will additionally be described as required.

Configuration 1.

A glow plug according to this configuration is a glow plug including:

a cylindrical housing having an axial hole which extends in a direction of an axis and provided with, on an outer circumferential surface thereof, a screw portion for being screwed into a mounting hole of an internal combustion engine; and a heater member inserted into the axial hole in a state where at least a front end portion thereof projects from a front end of the housing, characterized in that:

the housing includes:

a cylindrical front-end-side body portion extending to the front end side from a front end of the screw portion; and a gasket portion lying adjacent to a front end side of the front-end-side body portion in the direction of the axis and bent at a bent portion provided at a rear end thereof so that at least a rear end portion thereof extends in a direction intersecting the direction of the axis, and the gasket portion includes a pressure contact portion in which a surface thereof located at an outer circumferential side is brought into pressure contact with a seat surface of the internal combustion engine when the screw portion is screwed into the mounting hole of the internal combustion engine.

Configuration 2.

The glow plug according to this configuration is characterized in that, in the above-described Configuration 1, one or more auxiliary bent portions are provided to a portion of the gasket portion at the front end side in the direction of the axis than the bent portion, and the gasket portion is bent at the auxiliary bent portions.

Configuration 3.

The glow plug according to this configuration is characterized in that, in the above-described Configuration 1 or 2, either of the following (a) or (b) is satisfied.

(a) a thread diameter of the screw portion is M12, and a thickness of the front-end-side body portion is 1.6 mm or thinner;

(b) the thread diameter of the screw portion is M10, M9 or M8, and the thickness of the front-end-side body portion is 0.9 mm or thinner.

Configuration 4.

The glow plug according to this configuration is characterized in that, in any one of the above-described Configurations 1 to 3, a thickness of the gasket portion is thinner than a thickness of the front-end-side body portion.

Configuration 5.

A method for manufacturing the glow plug according to this configuration is a method for manufacturing the spark plug described in any one of the above-described Configurations 1 to 4, the method including:

a housing forming process of forming the housing, characterized in that:

the housing forming process includes a step of forming a cylindrical housing intermediate product, which is to become the housing, by performing deep drawing processing to a plate-shaped metal material.

Effect of the Invention

According to the glow plug of Configuration 1, when the screw portion is screwed into the mounting hole of the internal combustion engine, not the front end surface of the housing but the surface of the pressure contact portion located at the outer circumferential side is brought into pressure contact with the seat surface of the internal combustion engine. Consequently, the contact area of the pressure contact portion with the seat surface can be made large sufficiently.

In addition, according to the glow plug of Configuration 1, at least the rear end portion of the gasket portion is bent in the direction which intersects the direction of the axis (that is, the direction in which an axial force is applied) at the bent portion which is provided at the rear end of the gasket portion. Namely, when an axial force is applied to the housing in association with the glow plug being mounted to the internal combustion engine, the gasket portion performs bending deformation at the bent portion, whereby the gasket portion has a spring property which works along the direction of the axis. Consequently, even when vibration associated with the operation of the internal combustion engine is applied, the pressure contact portion can be brought into contact with the seat surface in a more ensured fashion. As a result, as it has been described above, good gastightness can be ensured in the combustion chamber in cooperation with the increase in contact area of the pressure contact portion with the seat surface. Additionally, since a frictional force generated between the pressure contact portion and the seat surface can be increased, the looseness of the glow plug with respect to the internal combustion engine can be prevented in an ensured fashion.

According to the glow plug of Configuration 2, the spring property of the gasket portion can be enhanced further, whereby the pressure contact portion can be brought into contact with the seat surface in a more ensured and stable fashion. As a result, a further improvement in gastightness can be realized, and also the looseness of the glow plug can be prevented in a more ensured fashion.

According to the glow plug of Configuration 3, the thickness of the front-end-side body portion can be made sufficiently thin, thereby making it possible to realize a reduction in weight of the housing. Consequently, it is possible to realize an improvement in fuel economy and a reduction of the manufacturing production costs. Additionally, since heat of the heater member which is conducted towards the housing (the front-end-side body portion) can be reduced, it is possible to realize an improvement in quick temperature rising characteristic of the heater member and a reduction in electric power necessary to allow the heater member to reach the predetermined temperature.

It is noted that, in the event that the front-end-side body portion is made thin as described in Configuration 3, although the deterioration in gastightness and the looseness of the glow plug due to a reduction of the area of the pressure contact portion and a decrease in the axial force are particularly concerned about, by adopting Configuration 1 and the like, these concerns can be eliminated. In other words, Configuration 1 and the like are particularly useful in the glow plug in which the thickness of the front-end-side body portion is specified as in Configuration 3.

According to the glow plug of Configuration 4, when the screw portion is screwed into the mounting hole of the internal combustion engine, it is possible to allow the gasket portion to be deformed more easily than the front-end-side body portion. Consequently, the pressure contact portion can be brought into contact with the seat surface in a more ensured and stable fashion while preventing the reduction in axial force associated with the deformation of the front-end-side body portion. As a result, the gastightness can be improved further, and also an effect of preventing the looseness of the glow plug can be enhanced further.

According to the method for manufacturing the glow plug of Configuration 5, the housing intermediate product which is to become the housing is manufactured by deep drawing processing. Consequently, the housing which is made thin as a whole to be light in weight can be manufactured more easily, thereby making it possible to realize an improvement in productivity.

In addition, since the housing can be made thin as a whole, the housing can be made more light in weight. As a result, the working effect in terms of improved fuel economy and reduced manufacturing costs can be enhanced further.

BRIEF DESCRIPTION OF DRAWINGS

In FIG. 6, (a) is a partially cutaway front view showing a die and a punch which are used in forming a tool engagement portion, and (b) is a partially cutaway front view showing the die in which the housing intermediate product is disposed and the like.

MODE FOR CARRYING OUT THE INVENTION

Figure 1:
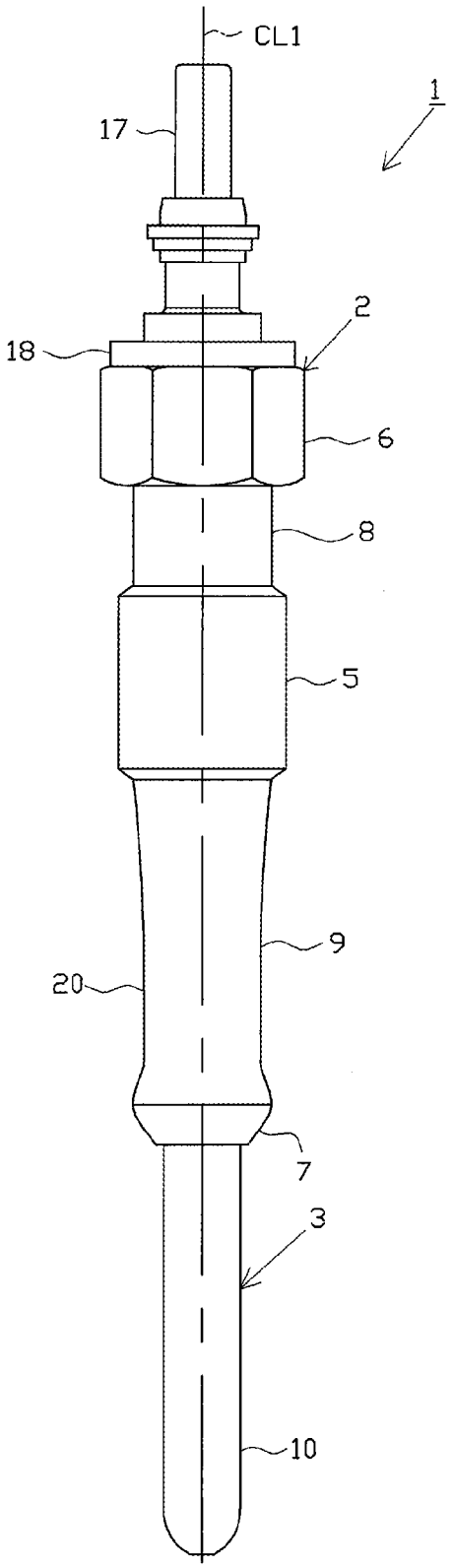
FIG. 1 is a front view of a glow plug.
Figure 2:
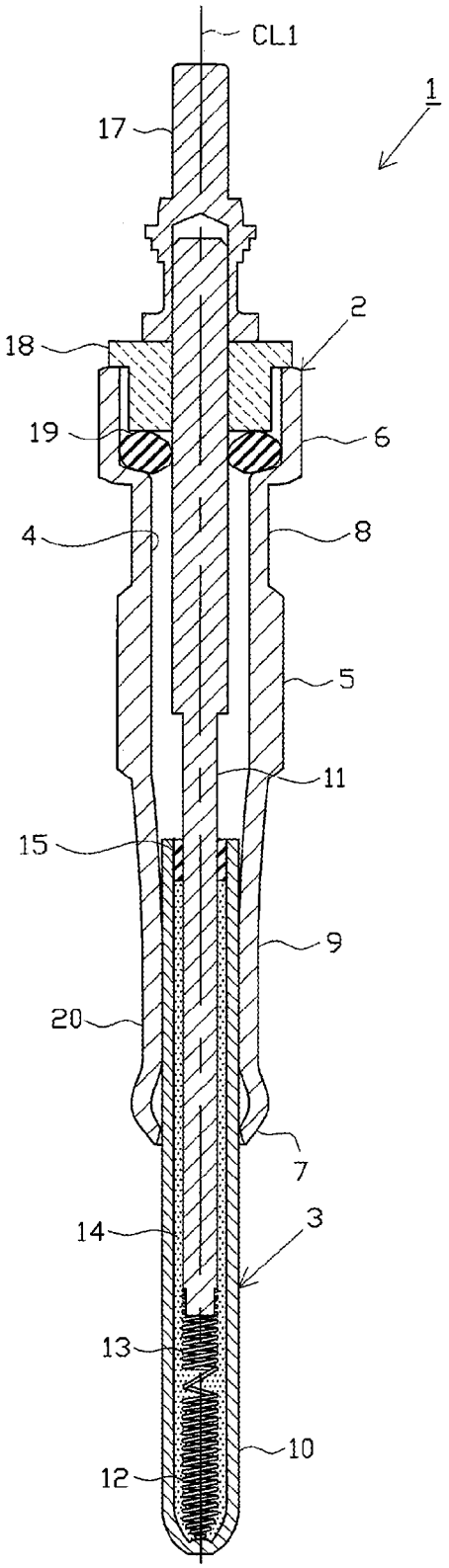
FIG. 2 is a partially cutaway front view of the glow plug.

Hereinafter, referring to the drawings, an embodiment will be described. FIG. 1 is a front view of a glow plug 1, and FIG. 2 is a partially cutaway front view of the glow plug 1. In FIG. 1 and the like, a direction of an axis CL1 of the glow plug 1 will be referred to as a vertical direction in the figures, and a lower side will be referred to as a front end side, whereas an upper side will be referred to as a rear end side of the glow plug 1.

As shown in FIGS. 1 and 2, the glow plug 1 includes a cylindrical housing 2 and a heater member 3 which is mounted to the housing 2.

The housing 2 is formed of a predetermined metal (for example, carbon steel, stainless steel or the like) and has an axial hole 4 which penetrates therethrough in the direction of the axis CL1. In addition, a screw portion 5 for being screwed into a mounting hole of an internal combustion engine such as a diesel engine or the like and a tool engagement portion 6 having a hexagonal cross section to which a tool such as a torque wrench or the like is brought into engagement when the glow plug 1 is mounted in the internal combustion engine are formed on an outer circumferential surface of the housing 2. It is noted that in this embodiment, the screw portion 5 has a thread diameter of M12. Additionally, an inner circumference of the tool engagement portion 6 is formed into a hexagonal shape in section which follows an outer circumferential shape of the tool engagement portion 6.

Further, the housing 2 includes a gasket portion 7 which lies adjacent to a front end side of a front-end-side body portion 9, which will be described later, in the direction of the axis CL1 and which is brought into pressure contact with a seat surface (not shown) of the internal combustion engine when the screw portion 5 is screwed into the mounting hole. The gastightness of a combustion chamber is ensured by the gasket portion 7 being brought into pressure contact with the seat surface. The configuration of the gasket portion 7 will be described in detail later.

In addition, the housing 2 includes a rear-end-side body portion 8 which is located between the screw portion 5 and the tool engagement portion 6 and the front-end-side body portion 9 which extends from a front end of the screw portion 5 towards the front end side and which is located between the gasket portion 7 and the screw portion 5. The rear-end-side body portion 8 is formed into a cylindrical shape and has an outer diameter which is constant along the direction of the axis CL1. On the other hand, the front-end-side body portion 9 has an outer circumferential surface and an inner circumferential surface which are curved. A hole diameter of the front-end-side body portion 9 constitutes a smallest hole diameter in the axial hole 4. The front-end-side body portion 9 is provided with a holding portion 20 which holds the heater member 3 at an inner circumference thereof. In this embodiment, the holding portion 20 is configured to have a smallest outer diameter in the front-end-side body portion 9.

Additionally, in this embodiment, the housing 2 is thin as a whole and has an almost uniform thickness. The thickness of the front-end-side body portion 9 is set to 1.6 mm or thinner. Here, when the screw portion 5 has a thread diameter of M8, M9 or M10, the thickness of the front-end-side body portion 9 is set to 0.9 mm or thinner. However, it is preferable that the thickness of the front-end-side body portion 9 is set to be equal to or larger than a predetermined value (for example, 0.3 mm) to ensure a sufficient strength for the front-end-side body portion 9.

The heater member 3 includes a tube 10, a heating coil 12 and a control coil 13 which are disposed in an interior of the tube 10 and is connected in series with a center pole 11 which is made of a predetermined metal (for example, an iron-based alloy or the like). Additionally, the heater member 3 is press fitted in the holding portion 20 with a front end portion thereof protruding from a front end of the housing to thereby be fixed to the housing 2.

The tube 10 is formed of a metal containing iron (Fe) or nickel (Ni) as a main composition (for example, a nickel-based alloy, a stainless steel alloy or the like) and is a cylindrical tube which is closed at a front end portion thereof. Additionally, the heating coil 12 which is joined to a front end of the tube 10 at a front end portion thereof and the control coil 13 which is connected in series with a rear end portion of the heating coil 12 are sealed in an inside of the tube 10 together with insulation powder 14 which contains magnesium oxide powder. Although the heating coil 12 electrically conducts with the tube 10 at a front end thereof, outer circumferential surfaces of the heating coil 12 and the control coil 13 and an inner circumferential surface of the tube 10 are insulated from each other by the insulation powder 14 interposed therebetween.

Further, an annular rubber 15 which is made of a predetermined rubber (for example, a silicone rubber or fluororubber or the like) is provided between an inner circumference of a rear end side of the tube 10 and the center pole 11, whereby the interior of the tube 10 is sealed.

The heating coil 12 is configured by winding a resistance heating wire which is made of a predetermined metal (for example, an alloy containing Al, Cr or the like in addition to Fe as a main composition, or the like) into a spiral shape. The heating coil 12 generates heat by being energized via the center pole 11.

In addition, the control coil 13 is configured by a material having a larger temperature coefficient of an electric specific resistance than that of the material of which the heating coil 12 is made, for example, a resistance heating wire which contains as a main composition Co or Ni which is represented by a cobalt (Co)—Ni—Fe based alloy or the like. By being so made, the control coil 13 increases an electric resistance value by generating heat in itself and receiving heat generated by the heating coil 12 therefrom to thereby control electric power supplied to the heating coil 12. Specifically, a relatively large magnitude of electric power is supplied to the heating coil 12 at an initial stage of energization, whereby the temperature of the heating coil 12 is raised. Then, the control coil 13 is heated as a result of the heating coil 12 being so heated, and this increases the electric resistance value of the control coil 13, whereby the supply of electric power to the heating coil 12 is reduced. The temperature rising characteristic of the heater member 3 is such that the temperature of the heater member 3 rises quickly at the initial stage of energization, whereafter the temperature thereof does not increase any further by the supply of electric power being suppressed by the action of the control coil 13. Namely, the existence of the control coil 13 makes it difficult for an excessive rise (an overshoot) in temperature of the heating coil 12 to occur while enhancing the quick temperature raising characteristic of the heater member 3.

The center pole 11 takes the form of a solid rod and a front end portion thereof is inserted into the interior of the tube 10. Then, with a frontmost end portion of the center pole 11 inserted in a rear end portion of the control coil 13, the center pole 11 and the control coil 13 are resistance welded together, whereby the center pole 11 and the control coil 13 are connected together.

Further, a cable connecting terminal pin 17 having a bottomed cylindrical shape is fixed to a rear end portion of the center pole 11 through crimping. Additionally, an insulation bush 18 which is made of an insulation material is provided between a front end portion of the terminal pin 17 and a rear end portion of the housing 2 so as to prevent a direct energization (short-circuiting) between the terminal pin 17 and the housing 2. In addition, with a view to realizing an improvement in gastightness in the axial hole 4, an annular seal member 19 which is made of an insulation material is provided between the housing 2 and the center pole 11 so as to be brought into contact with a front end portion of the insulation bush 18.

Incidentally, in this embodiment, as it has been described above, since the thickness of the front-end-side body portion 9 is set to 1.6 mm or thinner or 0.9 mm or thinner, in the event that a configuration like that of the prior art is adopted in which a front end surface of the housing 2 (the front-end-side body portion 9) is brought into pressure contact with the seat surface of the internal combustion engine, a contact area between the front end portion of the housing 2 and the seat surface becomes small. Consequently, sufficient gastightness may not be ensured in the combustion chamber.

Figure 3:
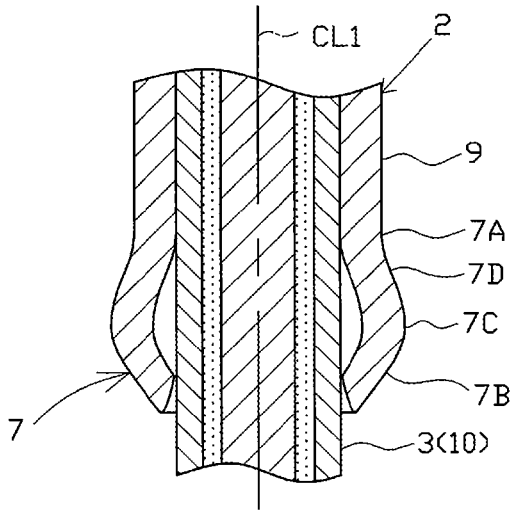
FIG. 3 is an enlarged sectional view showing the configuration of a gasket portion.

Taking this point into consideration, in this embodiment, the gasket portion 7 is configured as will be described below to ensure good gastightness in the combustion chamber. Namely, as shown in FIG. 3, the gasket portion 7 is bent at a bent portion 7A which is provided at a rear end thereof in such a way that at least a rear end portion 7D thereof extends in a direction which intersects the direction of the axis CL1 (in this embodiment, extends radially outwards towards the front end side in the direction of the axis CL1). Additionally, the gasket portion 7 has at a front end portion thereof a pressure contact portion 7B in which a surface thereof located at an outer circumferential side is brought into pressure contact with the seat surface of the internal combustion engine when the screw portion 5 is screwed into the mounting hole of the internal combustion engine.

Further, in this embodiment, an auxiliary bent portion 7C is provided to a portion of the gasket portion 7 at the front end side in the direction of the axis CL1 than the bent portion 7A, and the gasket portion 7 is bent at the auxiliary bent portion 7C. Namely, the gasket portion 7 of this embodiment is bent at a plurality of portions.

Figure 4:
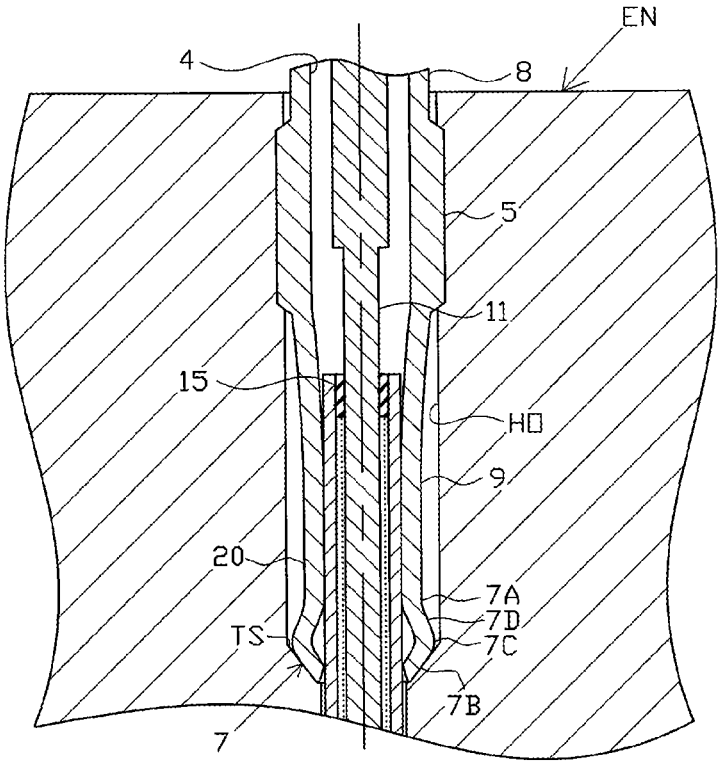
FIG. 4 is an enlarged sectional view showing the glow plug which is mounted in an internal combustion engine.

By the gasket portion 7 being configured as described above, when an axial force along the direction of the axis CL1 is applied to the housing 2, a bending deformation is generated at each of the bent portion 7A and the auxiliary bent portion 7C, whereby the gasket portion 7 has a spring property working along the direction of the axis CL1. Because of this, as shown in FIG. 4, when the screw portion 5 is screwed into the mounting hole HO in the internal combustion engine EN so that the pressure contact portion 7B is brought into pressure contact with the seat surface TS of the internal combustion engine EN, a bending deformation is generated in the gasket portion 7 at each of the bent portion 7A and the auxiliary bent portion 7C, whereby a reaction force directed towards the front end side in the direction of the axis CL1 (towards the seat surface TS) is applied to a portion of the pressure contact portion 7B which is in pressure contact with the seat surface TS.

In addition, in this embodiment, the thickness of the gasket portion 7 is set thinner than the thickness of the front-end-side body portion 9.

Next, a method for manufacturing the glow plug 1 which is configured as it has been described heretofore will be described below. It is noted that a conventionally known method is adopted for portions which will not be described specifically.

Firstly, a resistance heating wire containing Cr or Al in addition to Fe as a main composition is processed into a coil shape to obtain the heating coil 12. Additionally, a rear end portion of the heating coil 12 and a front end portion of the control coil 13 which is formed by processing a resistance heating wire of a Co—Ni—Fe based alloy into a coil shape are joined together through arc welding or the like.

Next, a front end of the center pole 11, and the heating coil 12 and the control coil 13 which are integrated with a front end of the center pole 11 are disposed within the cylindrical tube 10 which is formed larger in diameter by a working margin than a final dimension thereof and of which a front end is not closed. Then, a front end portion of the tube 10 is closed and the front end portion of the tube 10 and a front end portion of the heating coil 12 are joined together through arc welding.

Thereafter, after the insulation powder 14 is filled in the tube 10, the tube 10 is swaged to obtain the heater member 3 into which the tube 10 and the center pole 11 are integrated.

Figure 5:
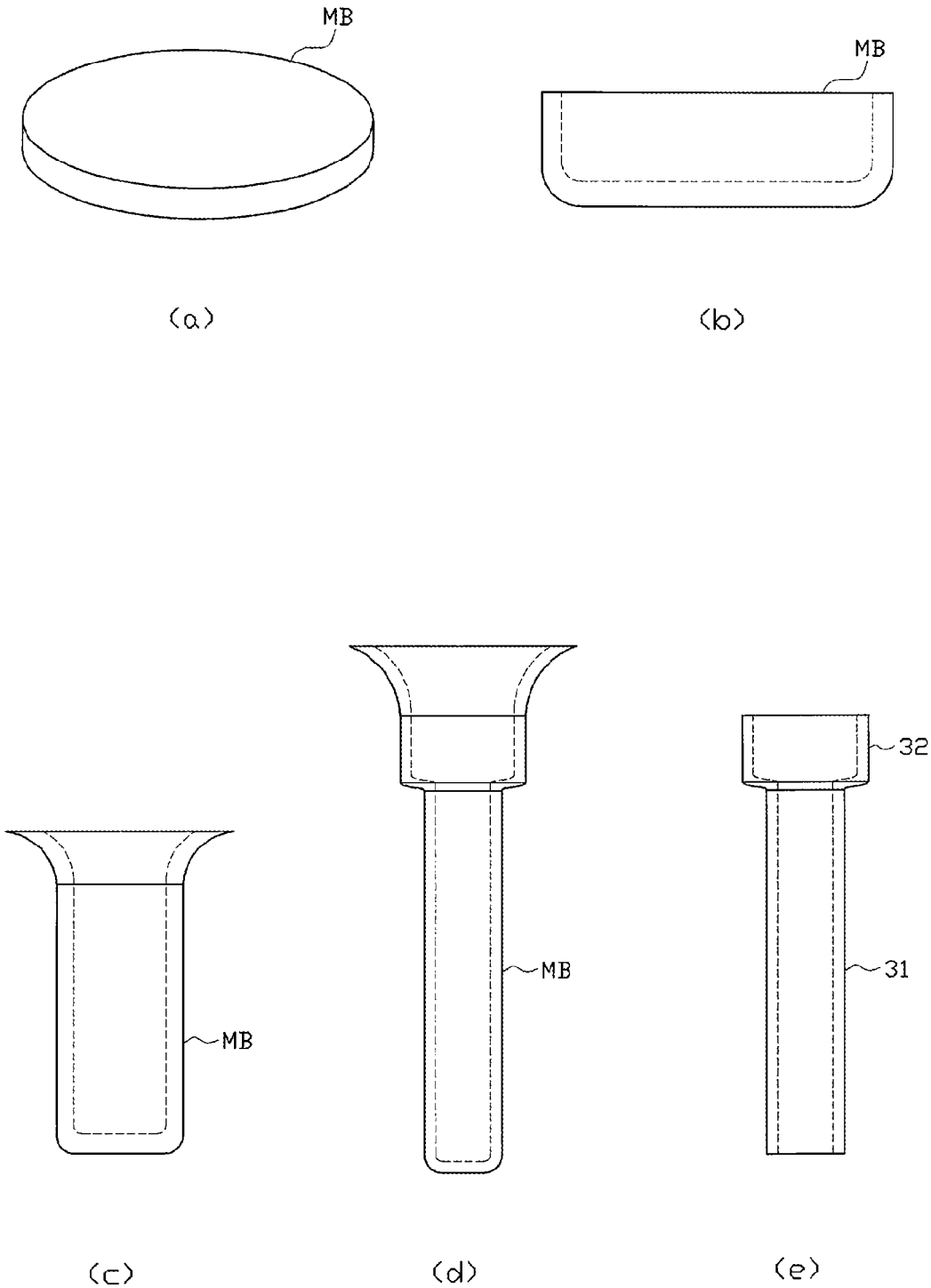
In FIG. 5, (a) is a perspective view of a metal material, (b) to (d) are front views showing a transition of the shape of the metal material through deep drawing processing, and (e) is a front view showing a housing intermediate product.

Next, in a housing forming process, the housing 2 is manufactured. Firstly, as shown in FIG. 5(*a*), a circular disk-shaped metal material MB which is made of a predetermined iron-based material is prepared, and deep drawing processing is performed to the metal material MB to obtain a cylindrical housing intermediate product which is to become the housing 2. Specifically, the metal material MB is supplied to a transfer press (not shown) in which a plurality of rod-shaped punches (not shown), which have different outer diameters getting smaller in a gradual fashion, and a plurality of bottomed cylindrical dies (not shown), which have different hole diameters corresponding to the outer diameters of the punches, are mounted to be aligned with each other. Then, the metal material MB is pressed in a plurality of stages by using the punches and the dies, whereby the metal material MB is formed into a cylindrical shape and the depth of the cylindrical shape is gradually increased as shown in FIGS. 5(*b*) to (*d*). Then, finally, both end portions of the metal material MB are cut to thereby obtain a cylindrical housing intermediate product 31 with a generally uniform thickness as a whole as shown in FIG. 5(*e*). The housing intermediate product 31 has an engagement-portion corresponding portion 32 at one end thereof. The engagement-portion corresponding portion 32 has a relatively large diameter that corresponds to a tool engagement portion 6.

Figure 6:
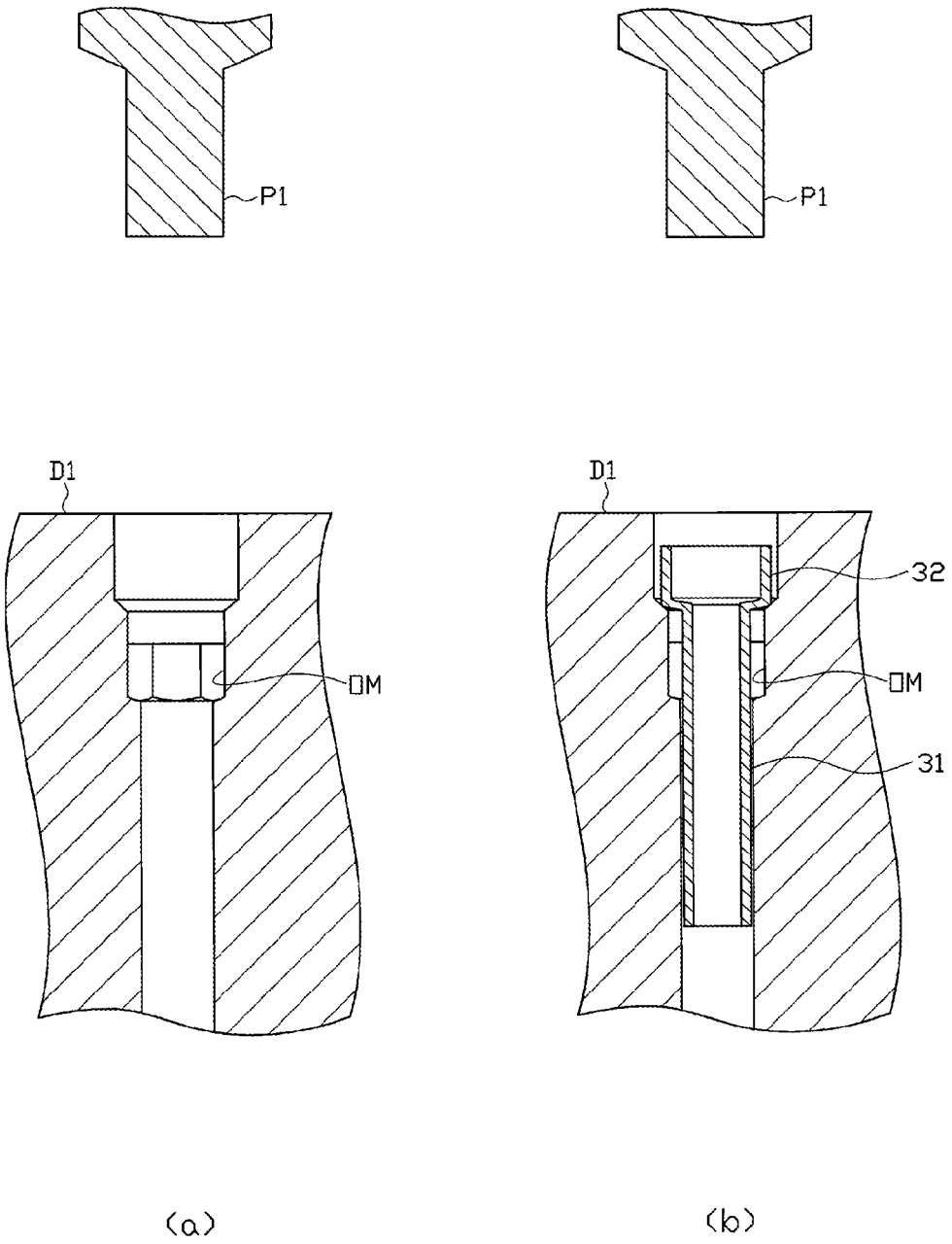
Figure 7:
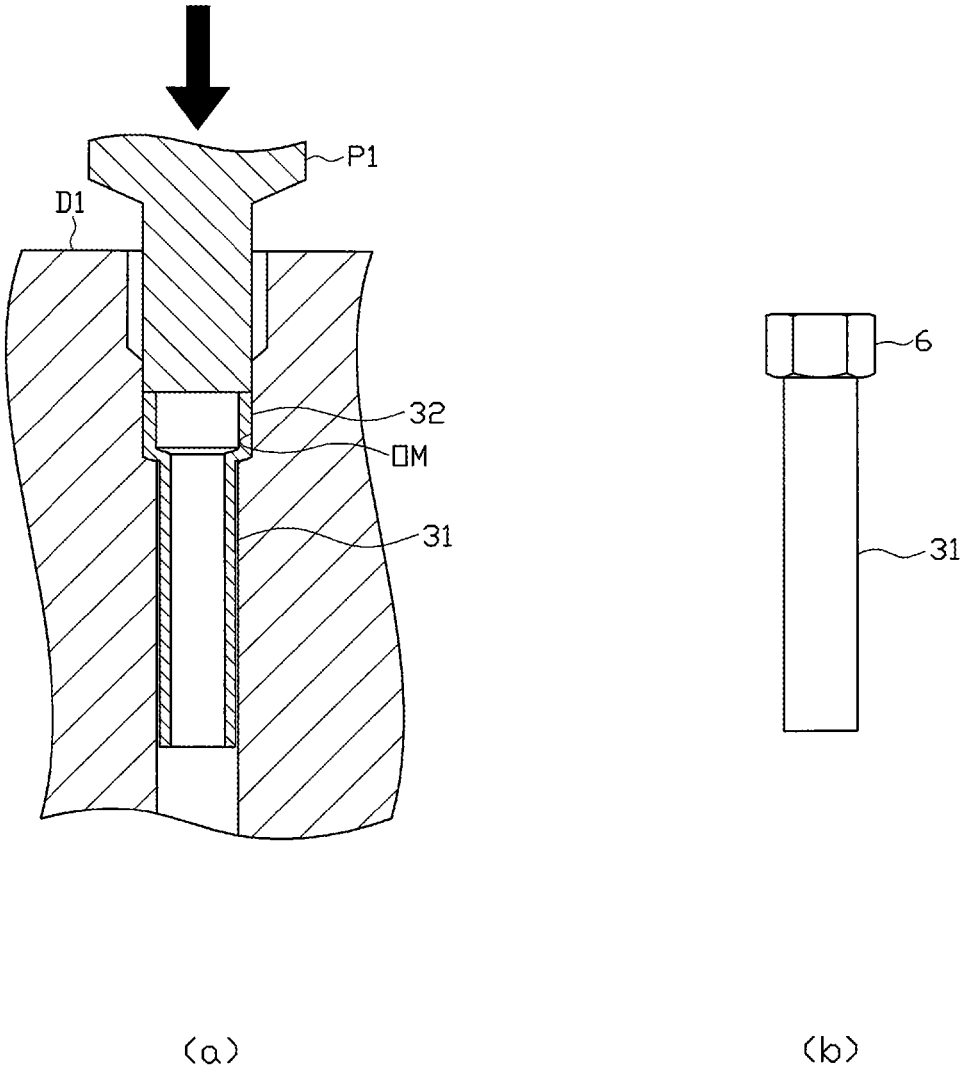
In FIG. 7, (a) is a partially cutaway front view showing one step of a tool engagement portion forming process, and (b) is a front view showing the housing intermediate product on which the tool engagement portion is formed.

Next, as shown in FIG. 6(*a*), by using a die D1 which has on an inner circumference thereof an outer circumference forming portion OM which has a shape corresponding to an outer circumferential shape of the tool engagement portion 6 and a vertically movable punch P1, the tool engagement portion 6 is formed. To describe this in detail, firstly, as shown in FIG. 6(*b*), the housing intermediate product 31 is disposed in an inner circumference of the die D1. Then, as shown in FIG. 7(*a*), the punch 1 is lowered, so that the engagement-portion corresponding portion 32 is pushed into the outer circumference forming portion OM in the die D1 by the punch P1. By doing so, both an outer circumference and an inner circumference of the engagement-portion corresponding portion 32 are formed into a hexagonal shape in section, whereby a tool engagement portion 6 is formed as shown in FIG. 7(*b*).

Next, an outer circumference of a front end side of the housing intermediate product 31 is pressed radially inwards to thereby deform a portion which corresponds to the front-end-side body portion 9, whereby the holding portion 20 is formed. Additionally, a screw portion 5 is formed at a predetermined portion of the housing intermediate product 31 through rolling.

Next, a front end portion of the housing intermediate product 31 is pressed to form the gasket portion 7 having the bent portion 7A and the auxiliary bent portion 7C at the front end portion of the housing intermediate product 31 to thereby obtain the housing 2.

Then, finally, the heater member 3 is press fitted in the holding portion 20 of the housing 2, and the insulation bush 18 and the seal member 19 are disposed on an outer circumference of a rear end portion of the center pole 11. Then, the terminal pin 17 is crimped and fixed to the rear end portion of the center pole 11, whereby the glow plug 1 is obtained.

Thus, as it has been described heretofore, according to this embodiment, when the screw portion 5 is screwed into the mounting hole HO in the internal combustion engine EN, the surface of the pressure contact portion 7B which is located on the outer circumferential side is brought into pressure contact with the seat surface TS of the internal combustion engine EN. Consequently, the contact area of the pressure contact portion 7B with the seat surface TS can be made large sufficiently.

In addition, at least the rear end portion 7D of the gasket portion 7 is bent in the direction which intersects the direction of the axis CL1 (that is, the direction in which an axial force is applied) at the bent portion 7A which is provided at a rear end of the gasket portion 7. Namely, when an axial force is applied to the housing 2 in association with the glow plug 1 being mounted to the internal combustion engine EN, the gasket portion performs bending deformation at the bent portion 7A, whereby the gasket portion 7 has the spring property which works along the direction of the axis CL1. Consequently, even when vibration associated with the operation of the internal combustion engine EN is applied, the pressure contact portion 7B can be brought into contact with the seat surface TS in a more ensured fashion. As a result, as it has been described above, good gastightness can be ensured in the combustion chamber in cooperation with the increase in contact area of the pressure contact portion 7B with the seat surface TS. Additionally, since a frictional force generated between the pressure contact portion 7B and the seat surface TS can be increased, the looseness of the glow plug 1 with respect to the internal combustion engine EN can be prevented in an ensured fashion.

Further, since the gasket portion 7 has the auxiliary bent portion 7C in addition to the bent portion 7A, the spring property of the gasket portion 7 can be enhanced. Consequently, the pressure contact portion 7B can be brought into pressure contact with the seat surface TS in a more ensured and stable fashion. As a result, a further improvement in gastightness be realized, and also the looseness of the glow plug can be prevented in a more ensured fashion.

In addition, since the thickness of the front-end-side body portion 9 is 1.6 mm or thinner, a reduction in weight of the housing 2 can be realized. Consequently, it is possible to realize an improvement in fuel economy and a reduction of the manufacturing costs. Additionally, since heat of the heater member 3 which is conducted towards the housing 2 (the front-end-side body portion 9) can be reduced, it is possible to realize an improvement in quick temperature rising characteristic of the heater member 3 and a reduction in electric power necessary to allow the heater member 3 to reach the predetermined temperature.

In addition to this, since the thickness of the gasket portion 7 is thinner than the thickness of the front-end-side body portion 9, when the screw portion 5 is screwed into the mounting hole HO in the internal combustion engine EN, it is possible to allow the gasket portion 7 to be deformed more easily than the front-end-side body portion 9. Consequently, the pressure contact portion 7B can be brought into contact with the seat surface TS in a more ensured and stable fashion while preventing the reduction in axial force associated with the deformation of the front-end-side body portion 9. As a result, the gastightness can be improved further, and also an effect of preventing the looseness of the glow plug 1 can be enhanced further.

In addition, since the housing 2 is made thin as a whole, it is possible to realize a further reduction in weight of the housing 2. As a result, it is possible to realize an improvement in fuel economy, a reduction of the manufacturing costs and the like in a more effective fashion.

Additionally, in this embodiment, the holding portion 20 has the smallest outer diameter in the front-end-side body portion 9.

Consequently, when an axial force is applied to the front-end-side body portion 9 in association with mounting the glow plug 1 in the internal combustion engine EN, the axial force is decomposed towards the heater member 3.

Because of this, although the housing 2 (the front-end-side body portion 9) is made thin as in this embodiment, it is possible to prevent a reduction in holding force of the heater member 3 by the holding portion 20 in an ensured fashion.

Further, in this embodiment, deep drawing processing is performed to the plate-shaped metal material MB to manufacture the housing intermediate product 31 which is to become the housing 2. Consequently, it is possible to facilitate the manufacturing of the housing 2 which is thin and light in weight as a whole, thereby making it possible to realize an improvement in productivity.

The invention is not limited to what is described in the embodiment and, for example, may also be carried out in the following manners. Naturally, it is, of course, possible to adopt other application and modified examples which will not be exemplified below.

Figure 8:
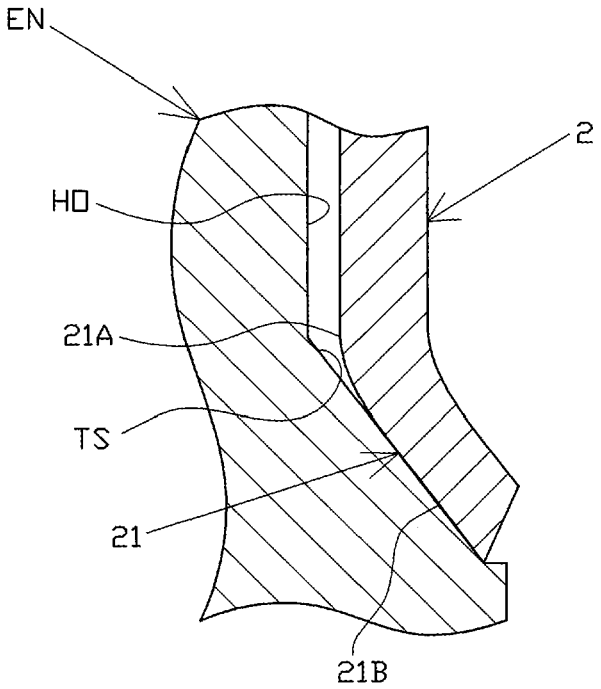
FIG. 8 is an enlarged end view showing the configuration of a gasket portion according to another embodiment.

(a) In the embodiment described above, the gasket portion 7 has the auxiliary bent portion 7C. In contrast with this, as shown in FIG. 8 [it is noted that FIGS. 8 to 11 are enlarged end views of the front end portion of the housing 2 and the internal combustion engine EN in which the housing 2 is mounted. In addition, in FIGS. 8 to 11, the gasket portion is shown in such a state that deformation that would result from pressure contact against the seat surface is not generated.], a gasket portion 21 may be configured to have a bent portion 21A and a pressure contact portion 21B without providing an auxiliary bent portion on the gasket portion 21.

Figure 9:
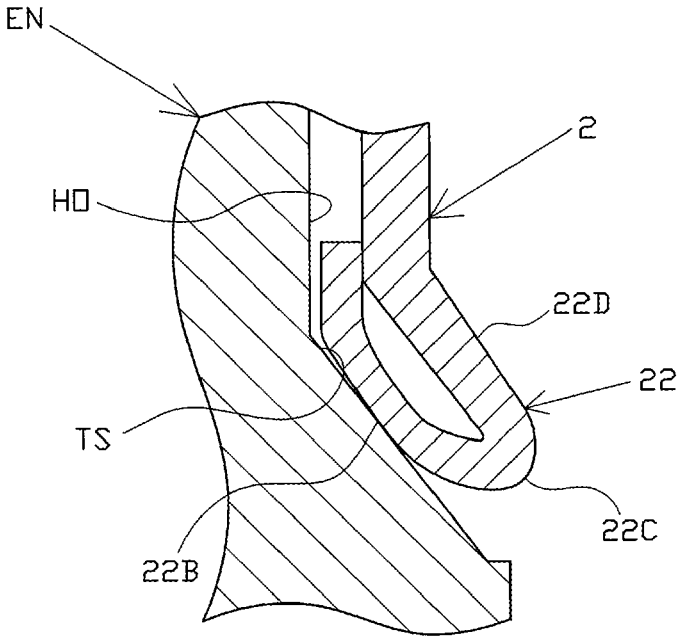
FIG. 9 is an enlarged end view showing the configuration of a gasket portion according to another embodiment.

Additionally, in the embodiment described above, while the rear end portion of the gasket portion 7 is shaped to extend radially outwards while being directed forwards in the direction of the axis CL1, as shown in FIG. 9, a rear end portion 22D of a gasket portion 22 may be shaped to extend radially inwards while being directed forwards in the direction of the axis CL1, and may be shaped so that the gasket portion 22 is bent back radially outwards at an auxiliary bent portion 22C, allowing a pressure contact portion 22B to be brought into pressure contact with the seat surface TS.

Figure 10:
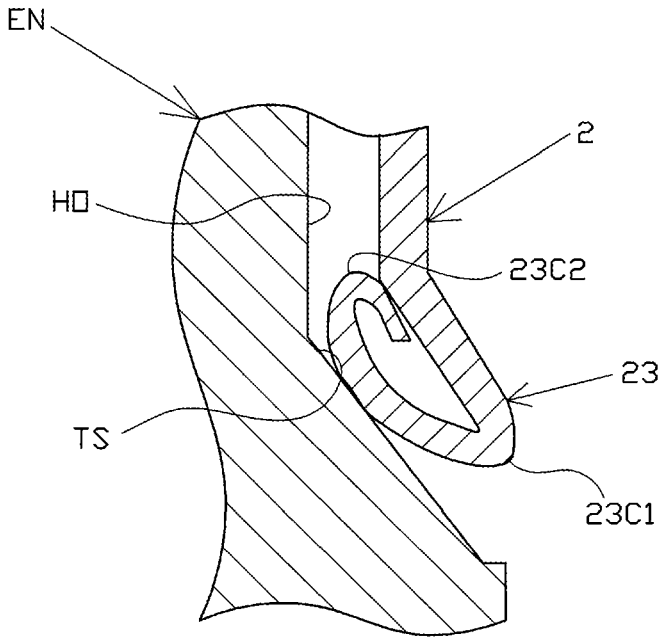
FIG. 10 is an enlarged end view showing the configuration of a gasket portion according to another embodiment.
Figure 11:
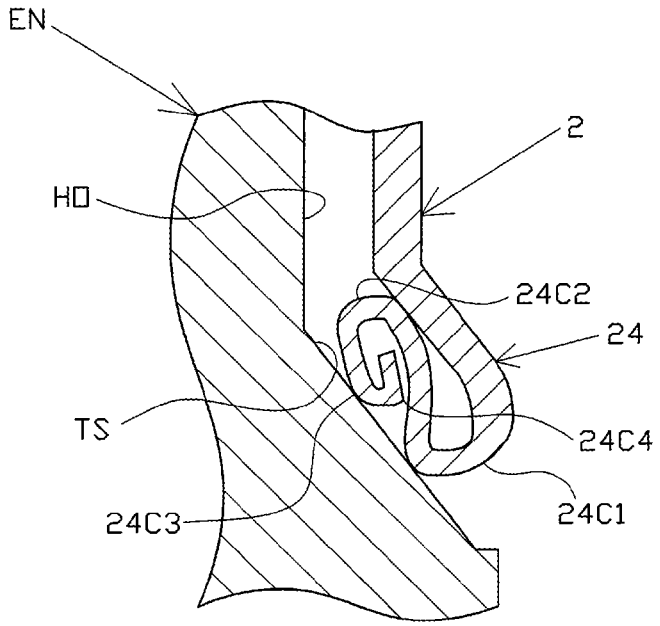
FIG. 11 is an enlarged end view showing the configuration of a gasket according to another embodiment.

Further, as shown in FIGS. 10 and 11, a plurality of auxiliary bent portions 23C1, 23C2 (24C1, 24C2, 24C3, 24C4) may be provided to a gasket portion 23 (24). By providing the plurality of auxiliary bent portions, the spring property of the gasket portions 23, 24 can be enhanced further, thereby making it possible to bring the pressure contact portion into pressure contact with the seat surface in a more ensured fashion.

(b) In the embodiment described above, while the control coil 13 is interposed between the heating coil 12 and the center pole 11 to prevent the excessive rise in temperature or overshoot of the heating coil 12, the control coil 13 may be omitted by bringing the heating coil 12 into direct contact with the center pole 11.

(c) In the embodiment described above, the heater member 3 is configured by the tube 10 and the heating coil 12 and the like which are disposed in the interior of the tube 10, and in this respect, the technical concept of the invention is applied to the so-called metal glow plug. In contrast with this, the technical concept of the invention may be applied to a so-called ceramic glow plug in which a heater member is configured by a cylindrical base member which is made of an insulation ceramic and a heating element which is provided in the base member, which is made of a conductive ceramic and which is energized via an center pole 11 to generate heat. Additionally, in this case, a heater member may be used which includes a conductive film which is provided on an external surface of the base member to constitute a heating element (a so-called surface heating type heater). Further, at least part of the heating element may be formed of a conductive metal (for example, an alloy containing tungsten as a main composition) which has superior heat resistance.

(d) In the embodiment described above, while the rear end portion (the cable connecting portion) of the glow plug 1 is configured so that the terminal pin 17 is crimped and fixed to the rear end of the center pole 11, the configuration of the glow plug 1 is not limited thereto. Consequently, for example, a configuration may be adopted in which an external thread is provided on an outer circumference of a portion of the center pole 11 which projects from the rear end of the housing 2, and a nut having an internal thread on an inner circumference thereof is screwed on the external thread while the nut is in contact with the insulation bush 18, so that the rear end portion of the center pole projects from the nut. Namely, the rear end portion of the center pole may be configured as the cable connecting portion.

Figure 12:
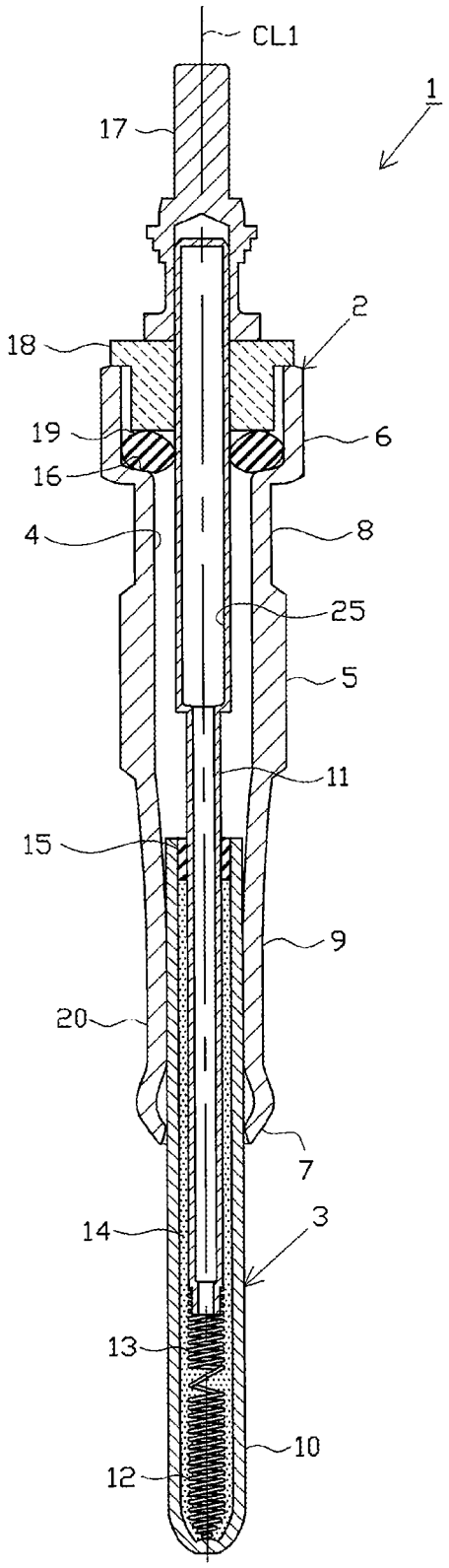
FIG. 12 is a partially cutaway front view showing the configuration of a glow plug according to another embodiment.

(e) In the embodiment described above, while the center pole 11 is formed as the solid rod-like member, as shown in FIG. 12, a hollow portion 25 may be provided in the center pole 11 so that the center pole 11 is formed into a tubular member. In this case, a further reduction in weight of the glow plug 1 can be realized, thereby making it possible to realize a further improvement in fuel economy. Additionally, since the heat of the heater member 3 (the heating coil 12) conducted to the center pole 11 can be reduced, the heater member 3 (the heating coil 12) is allowed to reach the predetermined temperature more quickly, and also electric power necessary to allow the heater member 3 to reach the predetermined temperature can be reduced further. Further, it is possible to effectively prevent the heat conduction from the control coil 13 to the center pole 11 in an effective fashion, whereby the temperature and hence resistance value of the control coil 13 can be increased more quickly. As a result, the control coil 13 allowed to exhibit its original function more quickly, and also a further conservation of electric power can be realized.

(f) In the embodiment described above, while the housing intermediate product 31 is formed through the deep drawing processing, the method for manufacturing the housing intermediate product 31 is not limited thereto. Consequently, for example, a predetermined metal material may be forged so as to obtain a housing intermediate product.

(g) In the embodiment described above, while the front-end-side body portion 9 has the curved surfaces on the outer and inner circumferences thereof and has the uniform thickness, the configuration of the front-end-side body portion 9 is not limited thereto. Consequently, for example, a configuration may be adopted in which the outer diameter of the front-end-side body portion 9 is made constant along the axis CL1, and only the holding portion 20 of the front-end-side body portion 9 is caused to project radially inwards so that only the holding portion 20 becomes relatively thick.

(h) In the embodiment described above, while the tool engagement portion 6 has the hexagonal cross-sectional shape, the shape of the tool engagement portion 6 is not limited to such a shape. Consequently, for example, the tool engagement portion 6 may have a Bi-HEX (a modified dodecagonal) shape [ISO22977:2005(E)] or the like.

(i) The shape of the heater member 3 is not specifically limited, and hence, for example, the heater member 3 may have an elliptic cross-sectional shape or an oval cross-sectional shape, or a polygonal cross-sectional shape. In addition, a so-called plate heater in which a plurality of plate-shaped insulating base members are formed and a heating element is sandwiched therebetween may be used as the heater member.

(j) The materials described as configuring the heating coil 12 and the control coil 13 in the embodiment described above are only examples, and hence, the material of the heating coil 12 or the like is not specifically limited.

DESCRIPTION OF REFERENCE NUMERALS AND CHARACTERS

1 glow plug;
2 housing;
3 heater member;
4 axial hole;
5 screw portion;
7 gasket portion;
7A bent portion;
7B pressure contact portion;
7C auxiliary bent portion;
9 front-end-side body portion;
31 housing intermediate product;
CL1 axis;
EN internal combustion engine;
HO mounting hole;
MB metal material;
TS seat surface.

The invention claimed is:

1. A glow plug comprising:

a cylindrical housing having an axial hole which extends in a direction of an axis and provided with, on an outer circumferential surface thereof, a screw portion for being screwed into a mounting hole of an internal combustion engine; and a heater member inserted into the axial hole in a state where at least a front end portion thereof projects from a front end of the housing, characterized in that:

the housing includes:

a cylindrical front-end-side body portion extending to the front end side from a front end of the screw portion and provided with a holding portion which holds the heater member at an inner circumference thereof; and a gasket portion lying adjacent to a front end side of the front-end-side body portion in the direction of the axis and bent at a bent portion provided at a rear end thereof so that at least a rear end portion thereof extends in a direction intersecting the direction of the axis, the gasket portion includes a pressure contact portion in which a surface thereof located at an outer circumferential side is brought into pressure contact with a seat surface of the internal combustion engine when the screw portion is screwed into the mounting hole of the internal combustion engine, the gasket portion performs bending deformation at the bent portion when the glow plug is mounted to the internal combustion engine, and wherein the holding portion which holds the heater member at the inner circumference thereof is provided to only the front-end-side body portion.

2. The glow plug according to claim 1, characterized in that:

one or more auxiliary bent portions are provided to a portion of the gasket portion at the front end side in the direction of the axis than the bent portion, and the gasket portion is bent at the auxiliary bent portions.

3. The glow plug according to claim 1, characterized in that:

either of the following (a) or (b) is satisfied, (a) a thread diameter of the screw portion is M12, and a thickness of the front-end-side body portion is 1.6 mm or thinner;

(b) the thread diameter of the screw portion is M10, M9 or M8, and the thickness of the front-end-side body portion is 0.9 mm or thinner.

4. The glow plug according to claim 1, characterized in that:

a thickness of the gasket portion is thinner than a thickness of the front-end-side body portion.

5. A method for manufacturing the glow plug according to claim 1, the method comprising:

a housing forming process of forming the housing, characterized in that:

the housing forming process includes a step of forming a cylindrical housing intermediate product, which is to become the housing, by performing deep drawing processing to a plate-shaped metal material.

* * * * *